US006835706B2

(12) United States Patent
Lentsch et al.

(10) Patent No.: US 6,835,706 B2
(45) Date of Patent: Dec. 28, 2004

(54) ALKALINE DETERGENT CONTAINING MIXED ORGANIC AND INORGANIC SEQUESTRANTS RESULTING IN IMPROVED SOIL REMOVAL

(75) Inventors: Steven E. Lentsch, St. Paul, MN (US); Keith E. Olson, Apple Valley, MN (US); Victor F. Man, St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 10/338,144

(22) Filed: Jan. 7, 2003

(65) Prior Publication Data

US 2003/0153480 A1 Aug. 14, 2003

Related U.S. Application Data

(63) Continuation of application No. 09/809,459, filed on Mar. 15, 2001, now Pat. No. 6,503,879, which is a continuation of application No. 09/691,012, filed on Oct. 18, 2000, now Pat. No. 6,436,893, which is a continuation of application No. 08/782,457, filed on Jan. 13, 1997, now Pat. No. 6,150,324.

(51) Int. Cl.[7] ..... C11D 17/06; C11D 7/18; C11D 3/00; C11D 7/54

(52) U.S. Cl. ..... 510/446; 510/224; 510/226; 510/305; 510/320; 510/374; 510/392

(58) Field of Search ..... 510/446, 392, 510/224.6, 305, 320, 374, 226

(56) References Cited

U.S. PATENT DOCUMENTS

| | | | |
|---|---|---|---|
| 1,580,576 | A | 4/1926 | Weidner |
| 1,949,264 | A | 2/1934 | Bagley |
| 2,412,819 | A | 12/1946 | MacMahon |
| 2,920,417 | A | 1/1960 | Wertheimer |
| 2,927,900 | A | 3/1960 | Shiraeff |
| 2,987,483 | A | 6/1961 | Brooker |
| 3,048,548 | A | 8/1962 | Martin et al. |
| 3,306,858 | A | 2/1967 | Oberle |

(List continued on next page.)

FOREIGN PATENT DOCUMENTS

| | | |
|---|---|---|
| AU | 687075 | 2/1953 |
| EP | 0 161 596 A2 | 5/1985 |

(List continued on next page.)

*Primary Examiner*—Margaret Einsmann
*Assistant Examiner*—Preeti Kumar
(74) *Attorney, Agent, or Firm*—Merchant & Gould P.C.

(57) ABSTRACT

Solid block alkaline detergent compositions are disclosed comprising a source of alkalinity, and other detergent additives including sequestrants. The solid block detergents of the invention used a mixed inorganic and organic sequestrant composition that successfully softens service water used in manufacturing aqueous detergents from the composition, but also obtains substantially improved organic soil removal on dishware or flatware. The solid block detergents of the invention comprise large masses of the chemical ingredients having a weight of greater than about 500 grams in a solid block product format that is typically dispensed using a spray on water dispenser that creates an aqueous concentrate that is used in a washing machine.

106 Claims, 1 Drawing Sheet

Figure 1:
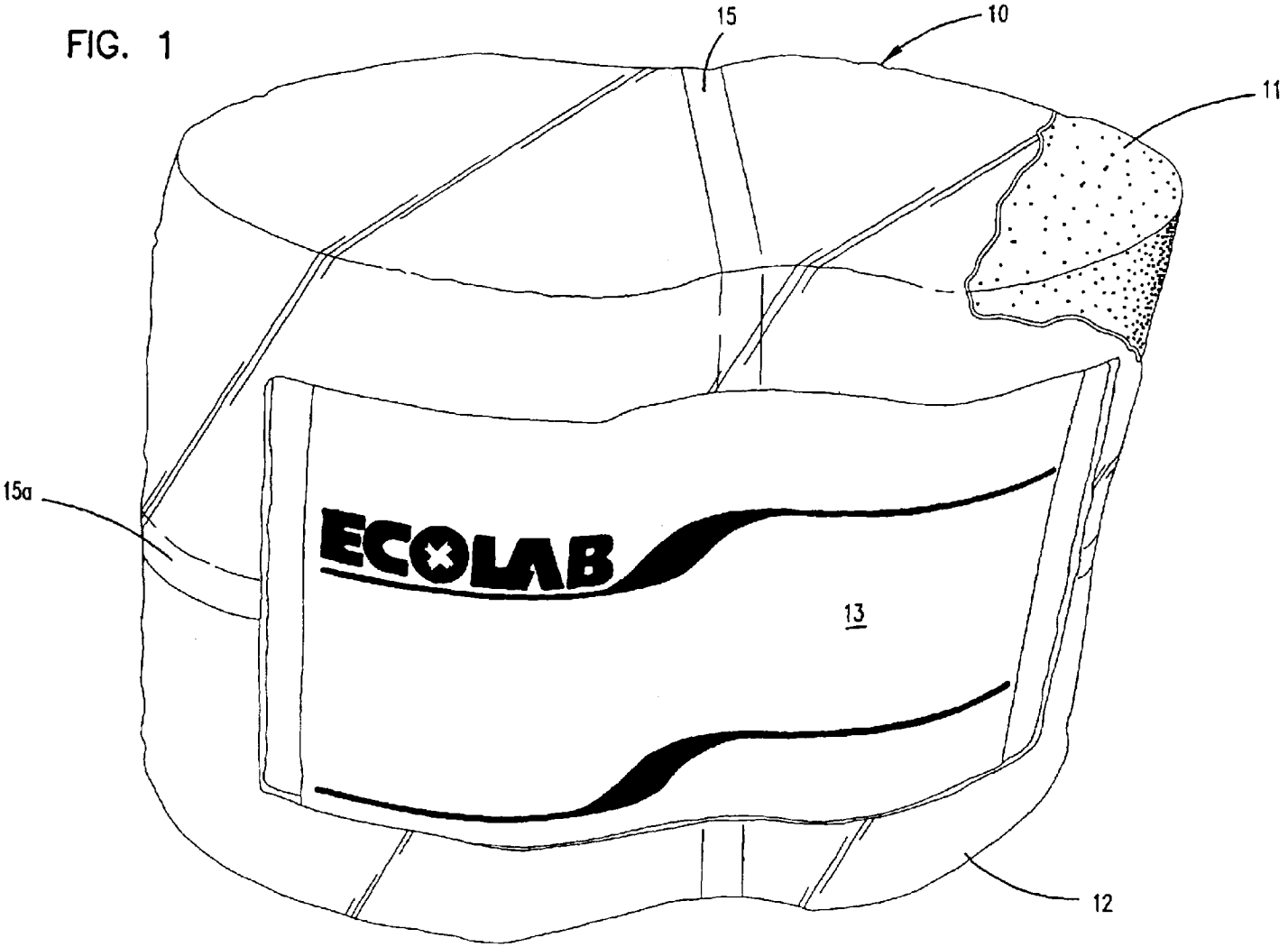

U.S. PATENT DOCUMENTS 3,334,147 A 8/1967 Brunelle et al.
3,351,558 A 11/1967 Zimmerer
3,382,178 A 5/1968 Lissant et al.
3,390,092 A 6/1968 Keast et al.
3,390,093 A 6/1968 Feierstein et al.
3,392,121 A 7/1968 Gedge III
3,441,511 A 4/1969 Otrhalek et al.
3,442,242 A 5/1969 Laskey et al.
3,491,028 A 1/1970 Crotty et al.
3,557,003 A 1/1971 Morris et al.
3,639,286 A 2/1972 Ballestra et al.
3,695,989 A 10/1972 Albert
3,790,482 A 2/1974 Jones et al.
3,816,320 A 6/1974 Corliss
3,846,346 A 11/1974 Conn
3,856,932 A 12/1974 May
3,887,614 A 6/1975 Susuki et al.
3,899,436 A 8/1975 Copeland et al.
3,933,670 A 1/1976 Brill et al.
3,936,386 A 2/1976 Corliss et al.
3,961,754 A 6/1976 Kuhns et al.
3,985,669 A 10/1976 Krummel et al.
4,000,080 A 12/1976 Bartolotia et al.
4,072,621 A 2/1978 Rose
4,083,795 A 4/1978 Joubert
4,105,573 A 8/1978 Jacobsen
4,147,650 A 4/1979 Sabatelli et al.
4,148,603 A 4/1979 Schwuger et al.
4,211,517 A 7/1980 Schmid
4,212,761 A 7/1980 Ciaccio
4,216,125 A 8/1980 Campbell et al.
4,219,436 A 8/1980 Gromer et al.
4,238,345 A 12/1980 Guilbert
4,243,543 A 1/1981 Guilbert et al.
4,261,868 A 4/1981 Hora et al.
4,268,406 A 5/1981 O'Brien et al.
4,274,975 A 6/1981 Corkill et al.
4,276,205 A 6/1981 Ferry
4,284,532 A 8/1981 Leikhim et al.
4,289,815 A 9/1981 Lee
4,329,246 A 5/1982 Gilbert et al.
4,348,293 A 9/1982 Clarke et al.
4,359,413 A 11/1982 Ward et al.
4,416,793 A 11/1983 Barrat et al.
4,426,362 A 1/1984 Copeland et al.
4,474,976 A 10/1984 Faltynek
4,481,167 A 11/1984 Ginter et al.
4,537,706 A 8/1985 Severson, Jr.
4,587,031 A 5/1986 Kruse et al.
4,594,175 A 6/1986 Copeland
4,595,520 A 6/1986 Heile et al.
4,605,509 A 8/1986 Corkill et al.
4,608,187 A 8/1986 Chang
4,608,189 A 8/1986 Koch et al.
4,618,914 A 10/1986 Sato et al.
4,664,848 A 5/1987 Oh et al.
4,677,130 A 6/1987 Puzig
4,680,134 A 7/1987 Heile et al.
4,687,121 A 8/1987 Copeland
4,690,305 A 9/1987 Copeland
4,692,494 A 9/1987 Sonenstein
4,695,284 A 9/1987 Hight
4,698,181 A 10/1987 Lewis
4,715,979 A 12/1987 Moore et al.
4,725,376 A 2/1988 Copeland
4,753,755 A 6/1988 Gansser
RE32,762 E 10/1988 Katzmann et al.
RE32,763 E 10/1988 Fernholtz et al.
RE32,818 E 1/1989 Fernholz et al.
4,826,661 A 5/1989 Copeland et al.
4,830,773 A 5/1989 Olson
4,836,951 A 6/1989 Totten et al.
4,845,965 A 7/1989 Copeland et al.
4,846,993 A 7/1989 Lentsch et al.
4,858,449 A 8/1989 Lehn
4,895,667 A 1/1990 Fox et al.
4,965,012 A 10/1990 Olson
4,983,315 A 1/1991 Glogowski et al.
5,019,292 A 5/1991 Baeck et al.
5,034,147 A 7/1991 Ramachandran
5,061,392 A 10/1991 Bruegge et al.
5,064,561 A 11/1991 Rouillard
5,078,301 A 1/1992 Gladfelter et al.
5,080,819 A 1/1992 Morganson et al.
5,118,426 A 6/1992 Duncan et al.
5,122,538 A 6/1992 Lokkesmoe et al.
5,173,207 A 12/1992 Drapier et al.
5,223,179 A 6/1993 Connor et al.
5,234,719 A 8/1993 Richter et al.
5,254,287 A 10/1993 Deleeuw et al.
5,290,496 A 3/1994 Carduck et al.
5,292,525 A 3/1994 Brenden et al.
5,312,561 A 5/1994 Hoshino et al.
5,316,688 A 5/1994 Gladfelter et al.
5,358,653 A 10/1994 Gladfelter et al.
5,382,377 A 1/1995 Raehse et al.
5,407,700 A 4/1995 Man et al.
5,419,850 A 5/1995 Backes et al.
5,429,766 A 7/1995 Sone et al.
5,451,336 A 9/1995 Schwadtke et al.
5,474,698 A 12/1995 Rolando et al.
5,494,817 A 2/1996 Chen
5,516,449 A 5/1996 Agar et al.
5,559,089 A 9/1996 Hartman et al.
5,578,134 A 11/1996 Lentsch et al.
5,589,099 A 12/1996 Baum
5,650,017 A 7/1997 Gordon et al.
5,665,694 A 9/1997 Backes et al.
5,691,292 A 11/1997 Marshall et al.
5,763,378 A 6/1998 Painter et al.
5,830,839 A * 11/1998 Scepanski ..... 510/305
5,858,117 A 1/1999 Oakes et al.
5,858,299 A 1/1999 Fernholz et al.
5,861,366 A 1/1999 Ihns et al.
5,876,514 A 3/1999 Rolando et al.
5,900,395 A * 5/1999 Nicholson et al. ..... 510/224
5,990,068 A 11/1999 Brouwer et al.
6,008,174 A 12/1999 Brouwer et al.
6,017,864 A 1/2000 Brittain et al.
6,060,444 A 5/2000 Schulz et al.
6,136,769 A 10/2000 Asano et al.
6,150,324 A * 11/2000 Lentsch et al. ..... 510/446
6,281,180 B1 * 8/2001 Tartakovsky et al. ..... 510/220
6,436,893 B1 * 8/2002 Lentsch et al. ..... 510/446
6,503,879 B2 * 1/2003 Lentsch et al. ..... 510/446

FOREIGN PATENT DOCUMENTS

EP 0 363 852 A1 4/1990
EP 0 364 840 A1 4/1990
EP 0 501 375 A1 9/1992
EP 0 364 840 B2 3/1996
GB 1 596 756 8/1981
GB 2 271 120 A 4/1994
JP 6-187800 5/1986
JP 9-217100 8/1997
WO WO 92/02611 2/1992
WO WO 92/13061 8/1992
WO WO 93/21299 10/1993
WO WO 95/18215 7/1995
WO WO 96/06910 3/1996

| | | |
|---|---|---|
| WO | WO 96/08555 | 3/1996 |
| WO | WO 96/41859 | 12/1996 |
| WO | WO 97/02753 | 1/1997 |
| WO | WO 97/05226 | 2/1997 |
| WO | WO 97/07190 | 2/1997 |
| WO | WO 98/54285 | 12/1998 |

* cited by examiner

ALKALINE DETERGENT CONTAINING MIXED ORGANIC AND INORGANIC SEQUESTRANTS RESULTING IN IMPROVED SOIL REMOVAL

This application is a continuation of Ser. No. 09/809,459 filed Mar. 15, 2001 now U.S. Pat. No. 6,503,879 which is a continuation of Ser. No. 09/691,012 filed Oct. 18, 2000 now U.S. Pat. No. 6,436,893 which is a continuation of Ser. No. 08/782,457 filed Jan. 13, 1997 now U.S. Pat. No. 6,150,324.

FIELD OF THE INVENTION

The invention relates to alkaline laundry or warewashing detergents. More particularly the invention relates to detergents in the form of a powder, liquid, pellet, solid block detergent, etc. composition containing a source of alkalinity and a variety of other detergent additive materials. The ingredients used in making the detergent cooperate to provide a variety of useful functions in the aqueous cleaning medium made from the improved detergent.

BACKGROUND OF THE INVENTION

Alkaline cleaning materials have been the source of intensive research and development for many years. Such products take the form of aqueous liquids, powders, pellets and solid blocks. In a number of markets such as warewashing and laundry, where safety and efficiency are paramount, solid block detergents have become a detergent of choice. Solid block compositions offer unique advantages over conventional detergents including improved handling and safety, elimination of component segregation during transportation and storage and increased concentration of active components within the composition. Further, the materials can be made in a hydrated form which produces less heat of hydration when dispensed. The materials disclosed in Fernholz, U.S. Reissue Patent Nos. 32,763 and 32,818 quickly replaced conventional powder and liquid forms of detergents in a number of industrial and institutional markets.

The detergents are typically used by dispensing the detergent with a water spray-on dispenser. In the dispenser, the detergent is combined with a major proportion of water producing a detergent concentrate solution that is added to wash water in a washing machine to form a wash solution. The wash solution, when contacted with a soiled article, successfully removes the soil from the article. Such detergency (soil removal) is most commonly obtained from a source of alkalinity used in manufacturing the detergent. Sources of alkalinity can include alkali metal hydroxides, alkali metal silicates, alkali metal carbonates and other typically inorganic based materials. Additional detergency can be obtained from the use of surfactant materials. Typically, anionic or nonionic surfactants are formulated into such detergents with other ingredients to obtain compositions that can be used to form cleaning solutions having substantial soil removal while controlling foam action. A number of optional detergent ingredients can enhance soil removal, but primarily soil removal is obtained from the alkalinity source and the anionic or nonionic surfactant.

One typical ingredient used in manufacturing cast solid detergents includes a hardness ion sequestering composition. Such compositions are used to soften water by sequestering typically divalent and trivalent metal ions that are commonly found in varying type and compositions of water drawn from local water utilities. Depending on geographical location, service water can contain substantial quantities of ferrous, ferric, manganese, magnesium, calcium and other divalent or trivalent inorganic species that can be present in hard water. Most locales have differing types and concentration of such inorganic species in the water. Typically greater than about 150 ppm of hardness ions determined as calcium is considered hard water in most locales. Most hardness sequestering agents act to complex such hardness ions using multivalent anionic inorganic and organic species. The most common inorganic sequestering agent, in these applications, comprises a condensed phosphate hardness sequestering agent such as tripolyphosphate, hexametaphosphate, pyrophosphate and other such phosphate materials. Similarly, more expensive organic sequestering agents are also known but are not preferred. Organic sequestering agents such as nitrilotriacetic acid, ethylene diamine tetraacetic acid, nitrilotriphosphonic acid, 1-(hydroxyethylidene)-1,1-diphosphonic acid and others have been known for many years to be effective sequestrants for detergents used in aqueous systems. One commonly available inorganic sequestrant, sodium tripolyphosphate is known to have protein peptizing capacity that tends to aid in the suspension of protein in washing solutions used in warewashing. However, to date sequestering agents have not been known to provide cleaning properties to detergent compositions.

Jacobsen, U.S. Pat. No. 4,105,573 discloses the use of a combination of an alkyl phosphonate, wherein the alkyl group contains 10–24 carbon atoms, with a particular class of alcohol ethoxylates to exhibit soil releasing effect. The preferred material is an octadecane phosphonate. Leikhim et al., U.S. Pat. No. 4,284,532 disclose an isotropic liquid using a phosphate ester or a "hydrophilic surfactant" such as sodium xylene sulfonate to couple with a builder and a surfactant in a cleaning composition. The cleaning composition can contain as a builder, DEQUEST-2010, 1-hydroxy-1,1-ethylidene diphosphonate or a similar phosphonate compound.

Baeck et al., U.S. Pat. No. 5,019,292 teach a fabric softening clay in a laundry detergent. Ethylene diamine tetramethylene phosphonic acid is used as a builder in certain examples without other sequestrant compositions.

Krummel et al, U.S. Pat. No. 3,985,669, Campbell et al., U.S. Pat. No. 4,216,125; O'Brien et al., U.S. Pat. No. 4,268,406; Corkill et al., U.S. Pat. No. 4,274,975; Ward et al., U.S. Pat. No. 4,359,413; Corkill et al., U.S. Pat. No. 4,605,509; Lewis, U.S. Pat. No. 4,698,181; and Bruegge et al., U.S. Pat. No. 5,061,392 teach that organic phosphonates can be successful co-builders that function by chelation of additional calcium and magnesium ions. Note that Lewis, U.S. Pat. No. 4,698,181 teaches that the overall detergent composition is successful at removing organic soil stains such as food and beverage stains. Glogowski et al., U.S. Pat. No. 4,983,315 teach a technology similar to that disclosed above and specifically teach that chelation agents can bind transition metals in soils to enhance cleaning performances.

Lastly, Bartolotia et al., U.S. Pat. No. 4,000,080; Rose, U.S. Pat. No. 4,072,621; Schwuger et al., U.S. Pat. No. 4,148,603; and Ferry, U.S. Pat. No. 4,276,205 teach that certain combinations of builders (not a combination of a condensed phosphate and an organophosphonate) provide good results in a particular application. The prior art shown here does not suggest that improved soil release capacity can be obtained by combining a condensed phosphate sequestrant with an organophosphonate sequestrant.

In any highly competitive market, a substantial need exists in improving the properties of detergent systems. In improving such systems, the cleaning properties of the systems are examined for the purpose of obtaining sufficient cleaning of all types of soils including inorganic soils, food soils such as fats, carbohydrates and proteins and organic soils obtained from the environment such as hydrocarbon oils, pigments, lipstick, etc. Such improved detergents can obtain adequate cleaning of a variety of soils at reduced concentrations.

BRIEF DISCUSSION OF THE INVENTION

We have discovered that, in the alkaline detergent compositions of the invention, a blend of an organic and an inorganic sequestering agent can substantially soften water and can substantially improve organic soil removal properties. More particularly, we have found that the combination of a source of alkalinity with a blend of a condensed phosphate sequestrant and an organic phosphonate sequestrant, wherein there is less than about 14.0%, preferably less than 8.7% total phosphorus (measured as P) in the composition and wherein there is at least about one part by weight of organic phosphonate sequestrant per each 100 parts by weight of the condensed phosphate sequestrant. Within these product ranges surprising and substantial organic soil removal is obtained with expected water softening.

We have found that the blend of the condensed phosphate sequestrant and the organic phosphonate sequestrant provides excellent water softening or water treatment of service water used in making the detergent concentrates of the invention, but also provide a substantially improved soil removal property for organic soils to the detergent. We have found that the source of alkalinity, a surfactant material and the mixed sequestrants cooperate to provide substantially improved soil removal when compared to similar detergents comprising a source of alkalinity, a surfactant and a single component sequestrant such as either sodium tripolyphosphate, an organophosphonate, or a polyacrylic material. Further, we have found that the detergents of this invention containing a blend of condensed phosphate and an organic phosphonate is superior to other sequestrant blends. The detergents of this invention including the condensed phosphate and the organic phosphonate is superior to a blend of, for example, sodium tripolyphosphate and a polyacrylic acid material. We have found that there is some aspect of the blend of a condensed phosphate and an organic phosphonate particularly in hard water to remove soils such as lipstick, coffee stains, etc. that substantially improved soil removal is obtained. We believe that there is some interaction between calcium, magnesium ion or other di- or trivalent metal species with substantially organic food stains dried from soil, lipstick and other soil sources. The interaction between the organic soil and the inorganic divalent or trivalent ions tend to form a difficult to remove soil. We believe that the combination of sequestrants improve the removability of the organic soil polyvalent metal blend.

We have found that the combination of a condensed phosphate sequestrant and an organophosphorus sequestrant provides the highest quality soil removal. For the purpose of this invention, "condensed phosphate" relates to an inorganic phosphate composition containing two or more phosphate species in a linear or cyclic polyphosphate form. The preferred condensed phosphate comprises sodium tripolyphosphate but can also include condensed-phosphate such as pyrophosphate, hexametaphosphate, cyclic condensed phosphates and other similar species well known to the artisan in detergent chemistry.

The term "organic phosphonate" includes a phosphonic acid, diphosphonic acid, triphosphonic acid, etc. compound or its alkali metal salts thereof. Such phosphonic acids are typically formulated having an organic compound or backbone having one or more pendent phosphonate groups. Typically, phosphonate groups are pendent off of nitrogen or carbon atoms in the core compound or polymer backbone. Such a phosphonate group typically has the formula:

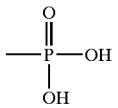

Such a group is characteristic of organophosphonic acid (phosphonate) compositions. Such organophosphonates include compounds such as aminotris(methylene phosphonic acid), 1-hydroxy-(ethylidene)-1,1-diphosphonic acid, 2-phosphonobutane-1,2,4-tricarboxylic acid, ethylene diamine tetra(methylene phosphonic acid), diethylene triamine penta(methylene phosphonic acid), ethanehydroxy-1,1,2-triphosphonates which can be hydroxy substituted where desired, oligomeric ester chain condensates of ethane-1-hydroxy-1,1-diphosphonates and other well known organic phosphonate species and their alkali metal salts thereof.

BRIEF DISCUSSION OF THE DRAWING

The FIGURE is an isometric drawing of the preferred wrapped solid detergent.

DETAILED DISCUSSION OF THE INVENTION

Active Ingredients

An alkaline detergent composition can include a source of alkalinity and minor but effective amounts of other ingredients such as a chelating agent/sequestrant blend, a bleaching agent such as sodium hypochlorite or hydrogen peroxide, an enzyme such as a protease or an amylase, and the like.

Alkaline Sources

The cleaning composition produced according to the invention may include minor but effective amounts of one or more alkaline sources to enhance cleaning of a substrate and improve soil removal performance of the composition. The alkaline matrix has a tenancy to solidify due to a change in state relating to work done by the manufacturing equipment or due to the activity of an alkaline source in fixing the free water present in a composition as water of hydration. Premature hardening of the composition may interfere with mixing of the active ingredients to form a homogeneous mixture, and/or with casting or extrusion of the processed composition. Accordingly, an alkali metal hydroxide or an alkali metal carbonate or other alkaline source is preferably included as a primary alkaline source in the cleaning composition in an amount effective to provide the desired level of cleaning action yet avoid premature solidification of the composition by the reaction of the caustic material with the other ingredients. However, it can be appreciated that an alkali metal hydroxide or other hydratable alkaline source can assist to a limited extent, in solidification of the composition. It is preferred that the composition comprises about 0.1–70 wt-%, preferably about 10–60 wt-% of an alkaline source, most preferably about 20–55 wt-%. The cleaning capacity can be augmented with a second source of alkalinity. These percentages and others in the specification and claims are based on the actual active materials used. These composition materials are added as aqueous or other materials with an active content of (e.g.) 10% to 100% of the material.

For the purpose of this application, the alkalinity source can comprise a carbonate base source of alkalinity. Such an alkalinity source can comprise an alkali metal carbonate augmented by other caustic or basic materials. Typical carbonates include sodium carbonate ($Na_2CO_3$), potassium carbonate ($K_2CO_3$) or other typical carbonate sources. Such carbonates can contain as an impurity some proportion of bicarbonate ($HCO_3^-$). Such a carbonate source of alkalinity can be augmented using a variety of other inorganic sources of alkalinity or inorganic bases.

Suitable alkali metal hydroxides include, for example, sodium or potassium hydroxide. An alkali metal hydroxide may be added to the composition in the form of solid beads, dissolved in an aqueous solution, or a combination thereof. Alkali metal hydroxides are commercially available as a solid in the form of prilled beads having a mix of particle sizes ranging from about 12–100 U.S. mesh, or as an aqueous solution, as for example, as a 50 wt-% and a 73 wt-% solution. The cleaning composition may comprise an alkaline source other than an alkali metal hydroxide. Examples of useful alkaline sources include a metal silicate such as a sodium or a potassium silicate (with a $M_2O:SiO_2$ ratio of 1:3.5 to 5:1, M representing an alkali metal) or metasilicate, a metal borate such as sodium or potassium borate, and the like; ethanolamines and amines; and other like alkaline sources. Secondary alkalinity agents are commonly available in either aqueous or powdered form, either of which is useful in formulating the present cleaning compositions. The composition may include a secondary alkaline source in an amount of about 0.1 to 4 wt-%. Greater amounts can interfere with successful casting and can reduce product dimensional stability.

Cleaning Agents

The composition can comprises at least one cleaning agent which is preferably a surfactant or surfactant system. A variety of surfactants can be used in a cleaning composition, including anionic, cationic, nonionic and zwitterionic surfactants, which are commercially available from a number of sources. For a discussion of surfactants, see Kirk-Othmer, *Encyclopedia of Chemical Technology*, Third Edition, volume 8, pages 900–912. Preferably, the cleaning composition comprises an anionic or a nonionic-cleaning agent in an amount effective to provide a desired level of cleaning, preferably about 0–20 wt-%, more preferably about 1.5–15 wt-%.

Anionic surfactants useful in the present cleaning compositions, include, for example, carboxylates such as alkylcarboxylates and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Preferred anionics are sodium alkylarylsulfonate, alpha-olefinsulfonate, and fatty alcohol sulfates.

Nonionic surfactants useful in cleaning compositions, include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC™ (BASF-Wyandotte), and the like; and other like nonionic compounds. Silicone surfactants comprising a hydrophobic silicone group and a hydrophilic group such as ABIL B8852 can also be used.

Cationic surfactants useful for inclusion in a cleaning composition for sanitizing or fabric softening, include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$–$C_{18}$)dimethylbenzyl ammonium chloride, n-tetradecyldimethylbenzylammonium chloride monohydrate, a naphthylene-substituted quaternary ammonium chloride such as dimethyl-1-naphthylmethylammonium chloride, and the like; and other like cationic surfactants.

Detergent compositions made according to the invention may further include conventional additives such as a water softening agent-, apart from the claimed sequestrant blend, a bleaching agent, alkaline source, secondary hardening agent or solubility modifier, detergent filler, defoamer, anti-redeposition agent, a threshold agent or system, aesthetic enhancing agent (i.e., dye, perfume), and the like. Adjuvants and other additive ingredients will vary according to the type of composition being manufactured. The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. Preferably, a cleaning composition includes about 0.1–70 wt-%, preferably from about 5–60 wt-%, of a chelating/sequestering agent.

Useful aminocarboxylic acids include, for example, n-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as 1-hydroxyethane-1,1-diphosphonic acid $CH_3C(OH)[PO(OH)_2]_2$; aminotri(methylenephosphonic acid) $N[CH_2PO$ $(OH)_2]_3$; aminotri(methylenephosphonate), sodium salt,

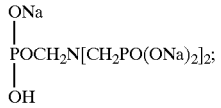

2-hydroxyethyliminobis(methylenephosphonic acid) $HOCH_2CH_2N[CH_2PO(OH)_2]_2$; diethylenetriaminepenta (methylenephosphonic acid) $(HO)_2POCH_2N[CH_2CH_2N[CH_2PO(OH)_2]_2]_2$; diethylenetriaminepenta (methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis (hexamethylene)triamine(pentamethylenephosphonic acid) $(HO_2)POCH_2N[(CH_2)_6N[CH_2PO(OH)_2]_2]_2$; and phosphorus acid $H_3PO_3$. A preferred phosphonate combination is ATMP and DTPMP. A neutralized or alkaline phosphosate, or a combination of the phosphonate with an alkali source prior to being added into the mixture such that there is little or no heat or gas generated by a neutralization reaction when the phosphonate is added is preferred. The warewashing detergents of the invention can contain about 5 to 40 wt.-% of the condensed phosphate preferably sodium polyphosphate; about 5 to 35 wt. % condensed phosphate, preferably 15 to 35 wt. % condensed phosphate, most preferably about 25 to 35 wt. % condensed phosphate. The warewashing detergents can contain about 0.1 to 15 wt.-% organic phosphonate, 1 to 10 wt.-% organic phosphonate, and preferably 5 to 15%-organic phosphonate.

Polycarboxylates suitable for use as cleaning agents include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, *Encyclopedia of Chemical Technology*, Third Edition, volume 5, pages 339–366 and volume 23, pages 319–320, the disclosure of which is incorporated by reference herein.

Bleaching agents for use in a cleaning compositions for lightening or whitening a substrate, include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the present cleaning compositions include, for example, chlorine-containing compounds such as a chlorine, a hypochlorite, chloramine. Preferred halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914, and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, preferably about 0.1–10 wt-%, preferably about 1–6 wt-%.

Secondary Hardening Agents/Solubility Modifiers

The present compositions may include a minor but effective amount of a secondary hardening agent, as for example, an amide such stearic monoethanolamide or lauric diethanolamide, or an alkylamide, and the like; a solid polyethylene glycol or a propylene glycol, and the like; starches that have been made water-soluble through an acid or alkaline treatment process; various inorganics that impart solidifying properties to a heated composition upon cooling, and the like. Such compounds may also vary the solubility of the composition in an aqueous medium during use such that the cleaning agent and/or other active ingredients may be dispensed from the solid composition over an extended period of time. The composition may include a secondary hardening agent in an amount of about 5–20 wt-%, preferably about 10–15 wt-%.

Detergent Builders or Fillers

A cleaning composition may include a minor but effective amount of one or more of a detergent filler which does not perform as a cleaning agent per se, but cooperates with the cleaning agent to enhance the overall cleaning capacity of the composition. Examples of fillers suitable for use in the present cleaning compositions include sodium sulfate, sodium chloride, starch, sugars, $C_1$–$C_{10}$ alkylene glycols such as propylene glycol, and the like. Preferably, a detergent filler is included in an amount of about 1–20 wt-%, preferably about 3–15 wt-%.

Defoaming Agents

A minor but effective amount of a defoaming agent for reducing the stability of foam may also be included in the present cleaning compositions. Preferably, the cleaning composition includes about 0.0001–5 wt-% of a defoaming agent, preferably about 0.01–3 wt-%.

Examples of defoaming agents suitable for use in the present compositions include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, polyoxyethylene-polyoxypropylene block copolymers, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-Redeposition Agents

A cleaning composition may also include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. A cleaning composition may include about 0.5–10 wt-%, preferably about 1–5 wt-%, of an anti-redeposition agent.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1 S-jasmine or jasmal, vanillin, and the like.

Aqueous Medium

The ingredients may optionally be processed in a minor but effective amount of an aqueous medium such as water to substantially blend and solubilize the ingredients and achieve a homogenous mixture, to aid in the hydration reaction if needed, to provide an effective level of viscosity for processing the mixture, and to provide the processed composition with the desired amount of firmness and cohesion during discharge and upon hardening. The mixture during processing preferably comprises about 2–20 wt-% of an aqueous medium, preferably about 5–15 wt-%. The extruded embodiment can contain less than about 1.3 moles of water per mole of alkalinity source, preferably less than 1.25 moles per mole of sodium carbonate.

DETAILED DESCRIPTION OF THE DRAWINGS

The FIGURE is a drawing of a preferred embodiment of the packaged solid block detergent of the invention. The detergent has a unique pinch waist elliptical profile. This profile ensures that this block with its particular profile can fit only spray on dispensers that have a correspondingly shaped location for the solid block detergent. We are unaware of any solid block detergent having this shape in the market place. The shape of the solid block ensures that no unsuitable substitute for this material can easily be placed into the dispenser for use in a warewashing machine. In FIG. 1 the overall product 10 is shown having a cast solid block 11 (revealed by the removal of packaging 12) with a mass of at least 500 gms, preferably 1 to 10 kg. The packaging includes a label 13. The film wrapping can easily be removed using a tear line or fracture line 15 or 15a incorporated in the wrapping.

Processing of the Composition

The detergent compositions of the invention can comprise powdered, agglomerated, liquid, pellet and solid block detergents. The powdered, agglomerated, liquid and pellet compositions can be made conventionally.

The invention provides a method of processing a solid block cleaning composition. According to the invention, a cleaning agent and optional other ingredients are mixed in an aqueous medium. A minimal amount of heat may be applied from an external source to facilitate processing of the mixture.

The alkaline cast solid materials of the invention can be manufactured in batch processing. In such processing, one or more of the ingredients used in making the cast solid materials can be charged to a mixing vessel that can be equipped with a heating source such as hot water, steam, electrical heaters, etc. The container and its charge can be heated to an effective mixing temperature and the balance of ingredients can be added. Once mixed and fully uniform, the agitated contents can then be removed from the batch mixer into molds or containers for solidification. Alternatively, the mixing of the ingredients can be accomplished in a series of two or more batch mixing vessels, each equipped with its own agitator and heat source. Ingredients can be added singly to any specific mixing apparatus or can be combined to make a premix which can be charged to a mixing apparatus prior to the addition of other ingredients or can be added to one or more ingredients in mixing apparatus.

Optional mixing system provides for continuous mixing of the ingredients at high shear to form a substantially homogeneous liquid or semi-solid mixture in which the ingredients are distributed throughout its mass. Preferably, the mixing system includes extrusion means for mixing the ingredients to provide shear effective for maintaining the mixture at a flowable consistency, with a viscosity during processing of about 1,000–1,000,000 cP, preferably about 50,000–200,000 cP. The mixing system is preferably a continuous flow mixer (extruder), as for example, a Teledyne continuous processor or a Breadsley Piper continuous mixer, more preferably a single or twin screw extruder apparatus, with a twin-screw extruder being highly preferred, as for example, a multiple section Buhler Miag twin screw extruder.

It is preferred that the mixture is processed at a temperature to maintain stability of the ingredients, preferably at ambient temperatures of about 20–80° C., more preferably about 30–50° C. Although limited external heat may be applied to the mixture, it can be appreciated that the temperature achieved by the mixture may become elevated during processing due to variances in ambient conditions, and/or by an exothermic reaction between ingredients. Optionally, the temperature of the mixture may be increased, for example, at the inlets or outlets of the mixing system, by applying heat from an external source to achieve a temperature of about 50–150° C., preferably about 55–70° C., to facilitate processing of the mixture.

Optionally, the mixing system can include means for milling the ingredients to a desired particle size. The components may be milled separately prior to being added to the mixture, or with another ingredient. An ingredient may be in the form of a liquid or a solid such as a dry particulate, and may be added to the mixture separately or as part of a premix with another ingredient, as for example, the cleaning agent, the aqueous medium, and additional ingredients such as a second cleaning agent, a detergent adjuvant or other additive, a secondary hardening agent, and the like. One or more premixes may be added to the mixture.

An aqueous medium may be included in the mixture in a minor but effective amount to solubilize the soluble ingredients, to maintain the mixture at a desired viscosity during processing, and to provide the processed composition and final product with a desired amount of firmness and cohesion. The aqueous medium may be included in the mixture as a separate ingredient, or as part of a liquid ingredient or premix.

The ingredients are mixed to form a substantially homogeneous consistency wherein the ingredients are distributed substantially evenly throughout the mass. The mixture is then discharged from the mixing system by casting into a mold or other container, by extruding the mixture, and the like. Preferably, the mixture is cast or extruded into a mold or other packaging system which can optionally, but preferably, be used as a dispenser for the composition. It is preferred that the temperature of the mixture when discharged from the mixing system is sufficiently low to enable the mixture to be cast or extruded directly into a packaging system without first cooling the mixture. Preferably, the mixture at the point of discharge is at about ambient temperature, about 20–50° C., preferably about 30–45° C. The composition is then allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained at or below the melting temperature of the ingredients, preferably at about 20–50° C.

When processing of the ingredients is completed, the mixture may be discharged from the mixer through a discharge port. The cast composition eventually hardens due, at least in part, to cooling and/or the chemical reaction of the ingredients. The solidification process may last from a minute to about 2–3 hours, depending, for example, on the size of the cast or extruded composition, the ingredients of the composition, the temperature of the composition, and other like factors. Preferably, the cast or extruded composition "sets up" or begins to harden to a solid form within about 1 minute to about 3 hours, preferably about 1 minute to about 2 hours, preferably about 1 minute to about 20 minutes.

Packaging System

Powdered, agglomerated, liquid and pellet detergents can be packaged in conventional envelopes, canisters, tubs, bottles, drums, etc.

The processed block compositions of the invention may be cast into temporary molds from which the solidified compositions may be removed and transferred for packaging. The compositions may also be cast directly into a packaging receptacle. Extruded material may also be cut to a desired size and packaged, or stored and packaged at a later time.

The packaging receptacle or container may be rigid or flexible, and composed of any material suitable for containing the compositions produced according to the invention, as for example, glass, steel, plastic, cardboard, cardboard composites, paper, and the like.

Advantageously, since the composition is processed at or near ambient temperatures, the temperature of the processed mixture is low enough so that the mixture may be cast or extruded directly into the container or other packaging receptacle without structurally damaging the receptacle material. As a result, a wider variety of materials may be used to manufacture the container than those used for compositions that processed and dispensed under molten conditions.

Preferred packaging used to contain the compositions is manufactured from a material which is biodegradable and/or water-soluble during use. Such packaging is useful for providing controlled release and dispensing of the contained cleaning composition. Biodegradable materials useful for packaging the compositions of the invention include, for example, water-soluble polymeric films comprising polyvinyl alcohol, as disclosed for example in U.S. Pat. No. 4,474,976 to Yang; U.S. Pat. No. 4,692,494 to Sonenstein; U.S. Pat. No. 4,608,187 to Chang; U.S. Pat. No. 4,416,793 to Haq; U.S. Pat. No. 4,348,293 to Clarke; U.S. Pat. No. 4,289,815 to Lee; and U.S. Pat. No. 3,695,989 to Albert, the disclosures of which are incorporated by reference herein.

Where the composition comprises a highly caustic material, safety measures should be taken during manufacture, storage, dispensing and packaging of the processed composition. In particular, steps should be taken to reduce the risk of direct contact between the operator and the solid cast composition, and the washing solution that comprises the composition.

The variety of cleaning composition made according to the present invention is dispensed from a spray-type dispenser such as that disclosed in U.S. Pat. Nos. 4,826,661, 4,690,305, 4,687,121, 4,426,362, Re Nos. 32,762 and 32,818 the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use. The spray is created by a spray head that can shape the spray pattern to match the solid detergent shape.

The above specification provides a basis for understanding the broad meets and bounds of the invention. The following examples and test data provide an understanding of the specific embodiments of the invention and contain a best mode. All sodium carbonate based examples were made by extrusion as disclosed herein. All caustic based products were made by the Fernholz molten process disclosed above.

Prepatatory Example

The experiment was run to determine the level of water needed to extrude a sodium carbonate product. The product of this example is a presoak but applies equally to a warewash detergent product. A liquid premix was made using water, nonyl phenol ethoxylate with 9.5 moles EO (NPE 9.5), a Direct Blue 86 dye, a fragrance and a Silicone Antifoam 544. These were mixed in a jacketed mix vessel equipped with a marine prop agitator. The temperature of this premix was held between 85–90° F. to prevent gelling. The rest of the ingredients for this experiment were sodium tripolyphosphate, sodium carbonate, and LAS 90% flake which were all fed by separate powder feeders. These materials were all fed into a Teledyne 2" paste processor. Production rates for this experiment varied between 20 and 18 lbs/minute. The experiment was divided into five different sections, each section had a different liquid premix feed rate, which reduced the amount of water in the formula. Product discharged the Teledyne through an elbow and a 1-½" diameter sanitary pipe. Higher levels of water to ash molar ratios (about 1.8–1.5) produced severe cracking and swelling. Only when levels of water approached 1.3 or less did we see no cracking or swelling of the blocks. Best results were seen at a 1.25 water to ash molar ratio. This shows an example that an extruded ash based product can be made but the water level has to be maintained at lower levels in order to prevent severe cracking or swelling.

EXAMPLE 1

Carbonate compositions were prepared in extrusion processes similar to those in the Preparatory Example. A sodium carbonate based detergent (formula 1) was tested vs. a NaOH based detergent (formula 2). The compositions of these two formulas are listed in Table 1.

TABLE 1

| | | Formula 1 | Formula 2 |
|---|---|---|---|
| (Alkalinity source) | NaOH | — | 45.6 |
| | $Na_2CO_3$ | 50.5 | 6.1 |
| (Chelating/water condition agent) | STPP* | 30.0 | 30.0 |
| | Sodium Aminotri-methylene Phosphonate | 6.7 | — |
| | Polyacrylic Acid | — | 1.6 |
| (Nonionic Defoamer) | EO/PO Block Polymer Defoamer | 1.5 | 1.4 |
| (Detergency enhancing surfactant) | Nonionic | 1.8 | — |
| (Other) | Ash - 11% water S.P. >>[water] | Inerts to 100 | Inerts to 100 |

*Sodium Tripolyphosphate (II) Test Procedures

A 10-cycle spot, film, protein, and lipstick removal test was used to compare formulas 1 and 2 under different test conditions. In this test procedure, three clean and five milk-coated Libbey glasses were washed in an institutional dish machine (a Hobart C-44) together with a lab soil and the test detergent formula. One clear glass was directly marked with a lipstick streak from top to bottom. The concentrations of each-detergent were maintained constant throughout the 10-cycle test.

The lab soil used is a 50/50 combination of beef stew and hot point soil. The hot point soil is a greasy, hydrophobic soil made of 4 parts Blue Bonnet all vegetable margarine and 1 part Carnation Instant Non-Fat milk powder.

In the test, the milk-coated glasses are used to test the soil removal ability of the detergent formula, while the initially clean glasses are used to test the anti-redeposition ability of the detergent formula. Milk coatings were made by dipping clean glasses into whole milk and conditioning the coated glass at 100° F. and 65% RH. At the end of the test, the glasses are rated for spots, film, and protein on the milk cooled glasses, and lipstick removal on the clean glasses. The rating scale is from 1 to 5 with 1 being the best and 5 being the worst results.

(III) Test Results

In example 1, formula 1 was compared with formula 2 in the 10-cycle spot, film, protein, and lipstick removal test under 1000 ppm detergent, 500 ppm food soil, and 5.5 grains city water conditions (moderate hardness). The test results are listed in Table 2.

TABLE 2

| | Spots | Film | Protein | Lipstick |
|---|---|---|---|---|
| Formula 1 (Ash) | 3.06 | 1.81 | 3.25 | Not Done |
| Formula 2 (Caustic) | 4.30 | 1.75 | 3.25 | Not Done |

These results show that under low water hardness and normal soil conditions, the ash-based formula 1 performs as well as the caustic-based formula 2.

EXAMPLE 2

In example 2, formula 1 was compared with formula 2 in the 10-cycle spot, film, protein, and lipstick removal test under 1500 ppm detergent, 2000 ppm food soil, and 5.5 grains city water conditions. The test results are listed in Table 3.

TABLE 3

| | Spots | Film | Protein | Lipstick |
|---|---|---|---|---|
| Formula 1 | 3.55 | 1.75 | 3.25 | 1.00 |
| Formula 2 | 3.20 | 2.50 | 3.00 | 5.00 |

These test results show that under low water hardness and heavy soil conditions, higher detergent concentrations can be used to get good spot, film, and protein results that are comparable to those obtained in Example 1. Surprisingly, formula 1 outperformed formula 2 in lipstick removal.

EXAMPLE 3

In example 3, formula 1 was compared with formula 2 in the 10-cycle spot, film, protein, and lipstick removal test under 1500 ppm detergent, 2000 ppm food soil, and 18 grains hard water conditions. The test results are listed in Table 4.

TABLE 4

| | Spots | Film | Protein | Lipstick |
|---|---|---|---|---|
| Formula 1 | 3.00 | 3.00 | 4.00 | 1.50 |
| Formula 2 | 5.00 | 3.00 | 5.00 | >5.00 |

These test results show that under high water hardness and heavy soil conditions, cleaning results generally suffer, even with higher detergent concentrations. However, formula 1 outperformed formula 2, especially in lipstick removal.

EXAMPLE 4

In order to evaluate the relative importance of the detergency enhancing nonionic surfactant (a benzyl ether of a $C_{10-14}$ linear alcohol (12.4 moles) ethoxylate, and the strong chelating agent (sodium aminotrimethylene phosphonate), in the ash-based detergent, four variations of formula 1 were compared vs. each other under 1000 ppm detergent, 500 ppm food soil, and 5.5 grain city water conditions. The test results are listed in Table 5.

TABLE 5

| | Spots | Film | Protein | Lipstick |
|---|---|---|---|---|
| Formula 1 | 3.25 | 1.75 | 3.25 | 1.00 |
| Formula 1A | 2.50 | 1.50 | 3.25 | 1.00 |
| Formula 1B | 3.00 | 1.50 | 3.25 | 2.00 |
| Formula 1C | 3.00 | 1.50 | 3.50 | 2.00 |

Formula 1A is formula 1 without nonionic

Formula 1B is formula 1 without nonionic and sodium aminotrimethylene phosphonate Formula 1C is formula 1 without sodium aminotrimethylene phosphonate These test results show that the chelating agents cooperate with the alkalinity sources to remove soil such as in lipstick removal.

EXAMPLE 5

Two caustic based detergents were evaluated, one with sodium aminotrimethylene phosphonate and the other without this raw material. The compositions of these two formulas are listed in Table 6.

TABLE 6

| | | Formula 3 | Formula 4 |
|---|---|---|---|
| (Alkalinity source) | NaOH | 47.50 | 47.5 |
| | $Na_2CO_3$ | 14.11 | 7.41 |
| (Chelating/water condition agent) | STPP | 28.50 | 28.50 |
| | Sodium Aminotrimethylene Phosphonate | | 1.34 |
| (Nonionic Defoamer) | EO/PO Block Polymer Defoamer | 1.34 | 1.4 |
| (Other) | | Inerts to 100 | Inerts to 100 |

Test Results:

In Example 5, formula 3 was compared to formula 4 in the 10 cycle spot, film protein, and lipstick removal test with 1000 ppm detergent, 2000 ppm food soil, and five grains city water conditions. The test results are listed in Table 7.

TABLE 7

| | Spots | Film | Protein | Lipstick |
|---|---|---|---|---|
| Formula 3 | 4.50 | 1.50 | 3.50 | 5.00 |
| Formula 4 | 3.00 | 1.75 | 2.50 | 3.0 |

These test results show that under low water hardness and heavy sol conditions, that the addition of sodium aminotrimethylene phosphonate to a caustic based detergent contributes to lipstick soil removal.

EXAMPLE 6

In Example 6, formula 3 was compared to formula 4 in the 10 cycle spot, film, protein and lipstick removal test with 1500 ppm detergent, 2000 ppm food soil, and five grains city water conditions. The test results are listed in Table 8.

TABLE 8

| | Spots | Film | Protein | Lipstick |
|---|---|---|---|---|
| Formula 3 | 2.75 | 1.50 | 2.50 | 5.00 |
| Formula 4 | 3.50 | 1.75 | 2.50 | 2.50 |

These test results show again at a higher detergent concentration that the addition of sodium aminotrimethylene phosphonate to the caustic detergent contributes to lipstick soil removal. Note that Formula 3 at 1500 ppm does not remove lipstick as well as Formula 4 at 1000 ppm. This combination of Example 5 and Example 6 demonstrates well the performance benefit of the invention.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A solid or agglomerate alkaline cleaning composition comprising:

about 0.1 to 70 wt. % alkaline source wherein, the amount of alkaline source is effective to provide the desired level of cleaning action yet avoid premature solidification of the composition by the reaction of the caustic material with the other ingredients;

about 0.1 to 15 wt. % organic phosphonate;

about 5 to 40 wt. % inorganic condensed phosphate;

bleaching agent, enzyme, or bleaching agent and enzyme.

2. The composition of claim 1, wherein the enzyme comprises protease or amylase.

3. The composition of claim 1, wherein the bleaching agent comprises an active oxygen source.

4. The composition of claim 3, wherein the active oxygen source comprises sodium hypochlorite, hydrogen peroxide, perborate, sodium carbonate peroxyhydrate, phosphate peroxyhydrate, potassium permonosulfate, or mixture thereof.

5. The composition of claim 4, wherein the perborate comprises sodium perborate mono and tetrahydrate.

6. The composition of claim 1, further comprising bleach activator.

7. The composition of claim 6, wherein the bleach activator comprises tetraacetylethylene diamine.

8. The composition of claim 1, comprising about 0.1–10 wt.-% bleaching agent.

9. The composition of claim 8, comprising about 1–6 wt.-% bleaching agent.

10. The composition of claim 1, wherein the alkaline source comprises alkali metal hydroxide, alkali metal carbonate, alkali metal silicate or metasilicate, alkali metal borate, ethanolamines, amines, or mixtures thereof.

11. The composition of claim 10, wherein the alkaline source comprises sodium hydroxide, potassium hydroxide, sodium carbonate, potassium carbonate, sodium borate, potassium borate, or mixtures thereof.

12. The composition of claim 1, wherein the alkaline source further comprises an alkali metal silicate with a $M_2O:SiO_2$ ratio of 1:3.5 to 5:1, wherein M represents an alkali metal.

13. The composition of claim 1, wherein the organic phosphonate comprises:

aminotri(methylenephosphonic acid);

1-hydroxyethane-1,1-diphosphonic acid;

aminotri(methylenephosphonate), sodium salt;

2-hydroxyethyliminobis(methylenephosphonic acid);

diethylenetriaminepenta(methylenephosphonic acid);

diethylenetriaminepenta(methylenephosphonate acid), sodium salt;

hexamethylenediamine(tetramethlenephosphonate), potassium salt;

bis(hexamethylene)triamine(pentamethylenephosphonic acid);

phosphorus acid; or mixtures thereof.

14. The composition of claim 1, wherein the condensed phosphate comprises sodium orthophosphate, potassium orthophosphate, sodium pyrophosphate, potassium pyrophosphate, sodium tripolyphosphate, sodium hexametaphosphate, or mixtures thereof.

15. The composition of claim 1, further comprising an additional functional ingredient, wherein the additional functional ingredient comprises surfactant hardening agent solubility modifier, detergent filler, defoamer, anti-redeposition agent, dye, odorant, or mixtures thereof.

16. The composition of claim 1, wherein the composition is provided in the form of a powder, a pellet, a block, or a mixture thereof.

17. A solid or agglomerate alkaline cleaning composition comprising:

about 20 to 70 wt. % alkaline source, wherein the amount of alkaline source is effective to provide the desired level of cleaning action yet avoid premature solidification of the composition by the reaction of the caustic material with the other ingredients;

a sequestrant mixture comprising an organic phosphonate and an inorganic condensed phosphate; and bleaching agent, enzyme, or bleaching agent and enzyme.

18. The composition of claim 17, wherein the enzyme comprises protease or amylase.

19. The composition of claim 17, wherein the bleaching agent comprises an active oxygen source.

20. The composition of claim 19, wherein the active oxygen source comprises sodium hypochlorite, hydrogen peroxide, perborate, sodium carbonate peroxyhydrate, phosphate peroxyhydrate, potassium permonosulfate, or mixture thereof.

21. The composition of claim 20, wherein the perborate comprises sodium perborate mono and tetrahydrate.

22. The composition of claim 17, further comprising bleach activator.

23. The composition of claim 22, wherein the bleach activator comprises tetraacetylethylene diamine.

24. The composition of claim 17, comprising about 0.1–10 wt.-% bleaching agent.

25. The composition of claim 24, comprising about 1–6 wt.-% bleaching agent.

26. The composition of claim 17, wherein the composition comprises about 1 to 10 wt. % organic phosphonate and about 10 to 40 wt. % inorganic condensed phosphate.

27. The composition of claim 17, wherein the composition comprises about 45 to 70 wt. % alkaline source.

28. The composition of claim 17, wherein the composition is provided in the form of a powder, an agglomeration, a pellet, a block, or a mixture thereof.

29. A solid or agglomerate alkaline cleaning composition comprising:

about 0.1 to 70 wt. % alkaline source, wherein the amount of alkaline source is effective to provide the desired level of cleaning action yet avoid premature solidification of the composition by the reaction of the caustic material with the other ingredients; the alkaline source comprising alkali metal hydroxide, sodium carbonate, potassium carbonate, sodium borate, potassium borate, or mixtures thereof;

about 0.1 to 70 wt. % aminocarboxylic acid; and about 5 to 40 wt. % inorganic condensed phosphate.

30. The composition of claim 29, comprising about 5–60 wt.-% aminocarboxylic acid.

31. The composition of claim 29, wherein the aminocarboxylic acid comprises n-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), or mixtures thereof.

32. The composition of claim 29, further comprising enzyme.

33. The composition of claim 32, wherein the enzyme comprises protease or amylase.

34. The composition of claim 29, further comprising bleaching agent.

35. The composition of claim 34, wherein the bleaching agent comprises sodium hypochlorite, hydrogen peroxide, perborate, sodium carbonate peroxyhydrate, phosphate peroxyhydrate, potassium permonosulfate, or mixture thereof.

36. The composition of claim 29, wherein the alkaline source further comprises an alkali metal silicate with a $M_2O:SiO_2$ ratio of 1:3.5 to 5:1, wherein M represents an alkali metal.

37. The composition of claim 29, wherein the condensed phosphate comprises sodium orthophosphate, potassium orthophosphate, sodium pyrophosphate, potassium pyrophosphate, sodium tripolyphosphate, sodium hexametaphosphate, or mixtures thereof.

38. The composition of claim 29, further comprising an additional functional ingredient, wherein the additional functional ingredient comprises surfactant, hardening agent, solubility modifier, detergent filler, defoamer, anti-redeposition agent, dye, odorant, or mixtures thereof.

39. The composition of claim 29, wherein the composition is provided in the form of a powder, a pellet, a block, or a mixture thereof.

40. A solid or agglomerate alkaline cleaning composition comprising:

about 20 to 70 wt. % alkaline source wherein the amount of alkaline source is effective to provide the desired level of cleaning action yet avoid premature solidification of the composition by the reaction of the caustic material with the other ingredients;

about 0.1 to 70 wt. % aminocarboxylic acid; and about 5 to 40 wt. % inorganic condensed phosphate.

41. The composition of claim 40, comprising about 5–60 wt.-% aminocarboxylic acid.

42. The composition of claim 40, wherein the aminocarboxylic acid comprises n-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), or mixtures thereof.

43. The composition of claim 40, further comprising enzyme.

44. The composition of claim 43, wherein the enzyme comprises protease or amylase.

45. The composition of claim 40, further comprising bleaching agent.

46. The composition of claim 45, wherein the bleaching agent comprises sodium hypochlorite, hydrogen peroxide, perborate, sodium carbonate peroxyhydrate, phosphate peroxyhydrate, potassium permonosulfate, or mixture thereof.

47. The composition of claim 40, wherein the composition comprises about 45 to 70 wt. % alkaline source.

48. The composition of claim 40, wherein the composition is provided in the form of a powder, an agglomeration, a liquid, a pellet, a block, or a mixture thereof.

49. A solid or agglomerate alkaline cleaning composition comprising:

(a) about 0.1 to 70 wt. % alkaline source, wherein the amount of alkaline source is effective to provide the desired level of cleaning action yet avoid premature solidification of the composition by the reaction of the caustic material with the other ingredients; the alkaline source comprising alkali metal hydroxide, alkali metal carbonate, alkali metal silicate or metasilicate, alkali metal borate, ethanolamines, amines, or mixtures thereof;

(b) about 0.1 to 15 wt. % organic phosphonate; and (c) about 5 to 40 wt. % inorganic condensed phosphate.

50. The composition of claim 49, wherein the alkaline source comprises sodium hydroxide, potassium hydroxide, sodium carbonate, potassium carbonate, sodium borate, potassium borate, or mixtures thereof.

51. A cleaning composition formed by the process comprising: solidifying a mixture comprising;

about 0.1 to 70 wt. % alkaline source;

about 0.1 to 15 wt. % organic phosphonate;

about 5 to 40 wt. % inorganic condensed phosphate; and bleaching agent, enzyme, or bleaching agent and enzyme;

and wherein the amount of alkaline source is effective to provide the desired level of cleaning action yet avoid premature solidification of the composition by the reaction of the caustic material with the other ingredients.

52. A cleaning composition formed by the process comprising:

solidifying a mixture comprising:

about 20 to 70 wt. % alkaline source, wherein the amount of alkaline source is effective to provide the desired level of cleaning action yet avoid premature solidification of the composition by the reaction of the caustic material with the other ingredients;

a sequestrant mixture comprising an organic phosphonate and an inorganic condensed phosphate, the sequestrant mixture at an amount effective for providing the composition with effective organic soil removal, water softening, or a combination thereof, and bleaching agent, enzyme, or bleaching agent and enzyme.

53. A cleaning composition formed by the process comprising:

solidifying a mixture comprising:

about 0.1 to 70 wt. % alkaline source, wherein the amount of alkaline source is effective to provide the desired level of cleaning action yet avoid premature solidification of the composition by the reaction of the caustic material with the other ingredients; the alkaline source comprising alkali metal hydroxide, sodium carbonate, potassium carbonate, sodium borate, potassium borate, or mixtures thereof;

about 0.1 to 70 wt. % aminocarboxylic acid; and about 5 to 40 wt. % inorganic condensed phosphate.

54. A cleaning composition formed by the process comprising:

solidifying a mixture comprising:

about 20 to 70 wt. % alkaline source, wherein the amount of alkaline source is effective to provide the desired level of cleaning action yet avoid premature solidification of the composition by the reaction of the caustic material with the other ingredients;

about 0.1 to 70 wt. % aminocarboxylic acid; and about 5 to 40 wt. % inorganic condensed phosphate.

55. A method of manufacturing a solid cleaning composition, the method comprising:

providing a mixture comprising:

about 0.1 to 70 wt. % alkaline source, wherein the amount of alkaline source is effective to provide the desired level of cleaning action yet avoid premature solidification of the composition by the reaction of the caustic material with the other ingredients;

about 0.1 to 15 wt. % organic phosphonate;

about 5 to 40 wt. % inorganic condensed phosphate; and bleaching agent, enzyme, or bleaching agent and enzyme; and solidifying the mixture.

56. A method of manufacturing a solid cleaning composition, the method comprising:

providing a mixture comprising:

about 20 to 70 wt. % alkaline source, wherein the amount of alkaline source is effective to provide the desired level of cleaning action yet avoid premature solidification of the composition by the reaction of the caustic material with the other ingredients;

a sequestrant mixture comprising an organic phosphonate and an inorganic condensed phosphate, the sequestrant mixture at an amount effective for providing the composition with effective organic soil removal, water softening, or a combination thereof; and bleaching agent, enzyme, or bleaching agent and enzyme; and solidifying the mixture.

57. A method of manufacturing a solid cleaning composition, the method comprising:

providing a mixture comprising:

about 0.1 to 70 wt. % alkaline source wherein the amount of alkaline source is effective to provide the desired level of cleaning action yet avoid premature solidification of the composition by the reaction of the caustic material with the other ingredients; the alkaline source comprising alkali metal hydroxide, sodium carbonate, potassium carbonate, sodium borate, potassium borate, or mixtures thereof;

about 0.1 to 70 wt. % aminocarboxylic acid; and about 5 to 40 wt. % inorganic condensed phosphate; and solidifying the mixture.

58. A method of manufacturing a solid cleaning composition, the method comprising:

providing a mixture comprising:

about 20 to 70 wt. % alkaline source wherein the amount of alkaline source is effective to provide the desired level of cleaning action yet avoid premature solidification of the composition by the reaction of the caustic material with the other ingredients;

about 0.1 to 70 wt. % aminocarboxylic acid; and about 5 to 40 wt. % inorganic condensed phosphate;

solidifying the mixture.

59. A method of cleaning an article, the method comprising:

providing a solid cleaning composition comprising:

about 0.1 to 70 wt. % alkaline source, wherein the amount of alkaline source is effective to provide the desired level of cleaning action yet avoid premature solidification of the composition by the reaction of the caustic material with the other ingredients;

about 0.1 to 15 wt. % organic phosphonate;

about 5 to 40 wt. % inorganic condensed phosphate; and bleaching agent, enzyme, or bleaching agent and enzyme; and dissolving at least a portion of the solid cleaning composition to create a use solution; and contacting the use solution with the article.

60. The method of claim 59, wherein the article is an article of ware.

61. The method of claim 59, wherein the article is an article of laundry.

62. The method of claim 59, wherein the method is used in a presoak application.

63. A method of cleaning an article, the method comprising:

providing a solid cleaning composition comprising:

about 20 to 70 wt. % alkaline source, wherein the amount of alkaline source is effective to provide the desired level of cleaning action yet avoid premature solidification of the composition by the reaction of the caustic material with the other ingredients; and a sequestrant mixture comprising an organic phosphonate and an inorganic condensed phosphate, the sequestrant mixture at an amount effective for providing the composition with effective organic soil removal, water softening, or a combination thereof; and bleaching agent, enzyme, or bleaching agent and enzyme; and dissolving at least a portion of the solid cleaning composition to create a use solution; and contacting the use solution with the article.

64. The method of claim 63, wherein the article is an article of ware.

65. The method of claim 63, wherein the article is an article of laundry.

66. The method of claim 63, wherein the method is used in a presoak application.

67. A method of cleaning an article, the method comprising:

providing a solid cleaning composition comprising:

about 0.1 to 70 wt. % alkaline source; the alkaline source comprising alkali metal hydroxide, sodium carbonate, potassium carbonate, sodium borate, potassium borate, or mixtures thereof; and about 0.1 to 70 wt. % aminocarboxylic acid, wherein the amount of alkaline source is effective to provide the desired level of cleaning action yet avoid premature solidification of the composition by the reaction of the caustic material with the other ingredients;

dissolving at least a portion of the solid cleaning composition to create a use solution; and contacting the use solution with the article.

68. The method of claim 67, wherein the article is an article of ware.

69. The method of claim 67, wherein the article is an article of laundry.

70. The method of claim 67, wherein the method is used in a presoak application.

71. A method of cleaning an article, the method comprising:

providing a solid cleaning composition comprising:

about 20 to 70 wt. % alkaline source, wherein the amount of alkaline source is effective to provide the desired level of cleaning action yet avoid premature solidification of the composition by the reaction of the caustic material with the other ingredients;

about 0.1 to 70 wt. % aminocarboxylic acid; and about 5 to 40 wt. % inorganic condensed phosphate; and solidification agent comprising the alkaline source;

dissolving at least a portion of the solid cleaning composition to create a use solution; and contacting the use solution with the article.

72. The method of claim 71, wherein the article is an article of ware.

73. The method of claim 71, wherein the article is an article of laundry.

74. The method of claim 71, wherein the method is used in a presoak application.

75. The composition of claim 1, wherein the composition is provided in the form of a tablet.

76. The composition of claim 17, wherein the composition is provided in the form of a tablet.

77. The composition of claim 29, wherein the composition is provided in the form of a tablet.

78. The composition of claim 40, wherein the composition is provided in the form of tablet.

79. The composition of claim 40, wherein the condensed phosphate comprises sodium orthophosphate, potassium orthophosphate, sodium pyrophosphate, potassium pyrophosphate, sodium tripolyphosphate, sodium hexametaphosphate, or mixtures thereof.

80. A solid or agglomerate alkaline cleaning composition comprising:

about 0.1 to 70 wt. % alkaline source, wherein the amount of alkaline source is effective to provide the desired level of cleaning action yet avoid premature solidification of the composition by the reaction of the caustic material with the other ingredients; the alkaline source comprising alkali metal hydroxide, sodium carbonate, potassium carbonate, sodium borate, potassium borate, or mixtures thereof;

about 0.1 to 15 wt. % organic phosphonate, polycarboxylate, or mixtures thereof;

about 5 to 40 wt. % inorganic condensed phosphate; and surfactant.

81. The composition of claim 80, wherein the composition comprises about 10 to 60 wt. % alkaline source.

82. The composition of claim 81, wherein the composition comprises about 20 to 55 wt. % alkaline source.

83. The composition of claim 80, wherein the alkaline source comprises sodium hydroxide, potassium hydroxide, or mixtures thereof.

84. The composition of claim 83, wherein the alkaline source comprises sodium hydroxide.

85. The composition of claim 84, wherein the composition comprises about 10 to 60 wt. % alkaline source.

86. The composition of claim 85, wherein the composition comprises about 20 to 55 wt. % alkaline source.

87. The composition of claim 83, comprising polycarboxylate.

88. The composition of claim 80, wherein the alkaline source comprises sodium carbonate, potassium carbonate, or mixtures thereof.

89. The composition of claim 88, wherein the alkaline source comprises sodium carbonate.

90. The composition of claim 88, comprising organic phosphonate and polycarboxylate.

91. The composition of claim 88, wherein the composition comprises about 10 to 60 wt. % alkaline source.

92. The composition of claim 91, wherein the composition comprises about 20 to 55 wt. % alkaline source.

93. The composition of claim 80, comprising alkali metal hydroxide and polycarboxylate.

94. The composition of claim 80, comprising sodium carbonate, organic phosphonate, and polycarboxylate.

95. The composition of claim 80, wherein the composition comprises about 1 to 10 wt. % organic phosphonate.

96. The composition of claim 80, wherein the organic phosphonate comprises:

aminotri(methylenephosphonic acid);

1-hydroxyethane-1,1-diphosphonic acid;

aminotri(methylenephosphonate), sodium salt;

2-hydroxyethyliminobis(methylenephosphonic acid);

diethylenetriaminepenta(methylenephosphonic acid);

diethylenetriaminepenta(methylenephosphonic acid), sodium salt;

hexamethylenediamine(tetramethlenephosphonate), potassium salt;

bis(hexamethylene)triamine(pentamethylenephosphonic acid);

phosphorus acid; or mixtures thereof.

97. The composition of claim 80, wherein the condensed phosphate comprises sodium orthophosphate, potassium orthophosphate, sodium pyrophosphate, potassium pyrophosphate, sodium tripolyphosphate, sodium hexametaphosphate, or mixtures thereof.

98. The composition of claim 80, wherein the polycarboxylate comprises polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers.

99. The composition of claim 80, further comprising an additional functional ingredient, wherein the additional functional ingredient comprises hardening agent, solubility modifier, detergent filler, defoamer, anti-redeposition agent, dye, odorant, or mixtures thereof.

100. The composition of claim 80, wherein the composition comprises up to about 20 wt. % surfactant.

101. The composition of claim 100, wherein the surfactant comprises nonionic surfactant, anionic surfactant, or mixtures thereof.

102. The composition of claim 100, wherein the surfactant comprises nonionic surfactant.

103. The composition of claim 102, wherein the nonionic surfactant comprises ethylene oxide/propylene oxide block copolymer.

104. The composition of claim 80, wherein the composition is provided in a solid form.

105. The composition of claim 80, wherein the composition is provided in the form of a powder, a pellet, a block, a tablet, or a mixture thereof.

106. The composition of claim 80, wherein the composition is provided in the form of a solid block formed within a container.

* * * * *